US010781703B2

(12) United States Patent
Ahmad et al.

(10) Patent No.: US 10,781,703 B2
(45) Date of Patent: Sep. 22, 2020

(54) TURBINE ROTOR BLADE

(71) Applicant: Siemens Aktiengesellschaft, Munich (DE)

(72) Inventors: Fathi Ahmad, Kaarst (DE); Radan Radulovic, Bochum (DE)

(73) Assignee: Siemens Aktiengesellschaft, Munich (DE)

( * ) Notice: Subject to any disclaimer, the term of this patent is extended or adjusted under 35 U.S.C. 154(b) by 484 days.

(21) Appl. No.: 15/519,698

(22) PCT Filed: Oct. 22, 2015

(86) PCT No.: PCT/EP2015/074435
§ 371 (c)(1),
(2) Date: Apr. 17, 2017

(87) PCT Pub. No.: WO2016/066511
PCT Pub. Date: May 6, 2016

(65) Prior Publication Data

US 2017/0241275 A1 Aug. 24, 2017

(30) Foreign Application Priority Data

Oct. 28, 2014 (EP) ..... 14190587

(51) Int. Cl.
*F01D 5/30* (2006.01)

(52) U.S. Cl.
CPC ..... *F01D 5/3007* (2013.01); *F05D 2250/294* (2013.01); *F05D 2250/712* (2013.01)

(58) Field of Classification Search
CPC . F01D 5/3007; F01D 5/22; F01D 5/26; Y10S 416/50; F05D 2240/80; F05D 2260/941
(Continued)

(56) References Cited

U.S. PATENT DOCUMENTS 5,836,744 A * 11/1998 Zipps ..... F01D 5/147 416/193 A
6,146,099 A 11/2000 Zipps et al.
(Continued)

FOREIGN PATENT DOCUMENTS

DE 19705323 A1 8/1998
DE 102009025814 A1 12/2009
(Continued)

OTHER PUBLICATIONS

EP Search Report dated Apr. 15, 2015, for EP patent application No. 14190587.7.
(Continued)

*Primary Examiner* — Long T Tran
*Assistant Examiner* — James J Kim
(74) *Attorney, Agent, or Firm* — Wolter Vandyke Davis, PLLC

(57) ABSTRACT

A turbine rotor blade for a thermal continuous flow machine, wherein a transition region and an aerodynamically shaped turbine blade connected to same, follows a blade foot for securing the turbine rotor blade to a rotor along a notional blade longitudinal axis of the turbine rotor blade from bottom to top. The blade foot has two flat end surfaces facing one another, two contoured side surfaces facing one another and joining the two end surfaces to one another, in which side surface at least one respective carrying edge is formed by creating dovetail- or fir tree-like end surface contour. The carrying edges become free edges or extend into the transition region via concave rounded portions. A channel bordering one of the two end sides is arranged in at least one concave rounded portion, the extension of which channel along the side surface is less than that of the carrying edge.

11 Claims, 3 Drawing Sheets

(58) Field of Classification Search
USPC ..... 416/219 R
See application file for complete search history.

(56) References Cited

U.S. PATENT DOCUMENTS

| | | | | |
|---|---|---|---|---|
| 9,151,167 | B2 * | 10/2015 | Zemitis | F01D 5/3007 |
| 9,359,905 | B2 * | 6/2016 | Lamicq | F01D 5/3007 |
| 2008/0063529 | A1 * | 3/2008 | Miller | F01D 5/3007 416/193 A |
| 2009/0087316 | A1 * | 4/2009 | Mueller | F01D 5/3038 416/219 R |
| 2009/0029735 | A1 | 12/2009 | Ravichand | |
| 2009/0297351 | A1 * | 12/2009 | Brahmasuraih | F04D 29/32 416/219 R |
| 2013/0209253 | A1 * | 8/2013 | Zemitis | F01D 5/3007 416/1 |
| 2013/0224036 | A1 * | 8/2013 | Lamicq | F01D 5/3007 416/234 |

FOREIGN PATENT DOCUMENTS

| | | | |
|---|---|---|---|
| EP | 2546465 | A1 | 1/2013 |
| EP | 2626516 | A1 | 8/2013 |

OTHER PUBLICATIONS

International Search Report dated Jan. 4, 2016, for PCT/EP2015/074435.

* cited by examiner

TURBINE ROTOR BLADE

CROSS REFERENCE TO RELATED APPLICATIONS

This application is the U.S. National Stage of International Application No. PCT/EP2015/074435 filed Oct. 22, 2015, and claims the benefit thereof. The International Application claims the benefit of European Application No. EP14190587 filed Oct. 28, 2014. All of the applications are incorporated by reference herein in their entirety.

FIELD OF INVENTION

The invention relates to a turbine rotor blade, in which a transition region, as well as an aerodynamically curved airfoil adjoining same, follows a blade root for securing the turbine rotor blade to a rotor of the turbine from bottom to top along a notional blade longitudinal axis of the turbine rotor blade, wherein the blade root has two mutually opposite flat end surfaces and two mutually opposite contoured side surfaces connecting the two end surfaces to one another, in each of which side surfaces at least one supporting flank is formed, forming a dovetail or firtree end surface contour, and in which the supporting flanks merge into the transition region or become free flanks via concave rounded portions.

BACKGROUND OF INVENTION

The turbine rotor blade described above is very well known from the prior art and is used, in particular, in gas turbines. To secure the turbine rotor blade on the rotor, the latter has either an encircling shaft collar or a rotor disk, on the outer circumference of which retention grooves extending very largely in an axial direction are provided. The retention grooves are distributed along the circumference of the shaft collar or of the rotor disk, thus ensuring that a dedicated retention groove is provided for each turbine rotor blade. In this case, the retention grooves are shaped to match the end side contour of the blade root of the turbine rotor blade, with the result that overall there is a positive connection between the turbine rotor blade and the rotor which reliably holds the turbine rotor blade on the rotor during correct operation of a turbine having the turbine rotor blade, irrespective of the centrifugal forces acting on the turbine rotor blade.

However, the centrifugal forces which occur can be so high, especially when operating stationary gas turbines, owing to the intrinsic weight of the turbine rotor blade, that the blade carrier is subject locally to excessively high loads. This locally impermissibly high loading leads to a reduced life of the blade carrier or of the rotor disk, this being unwanted.

Thus, EP 2 626 516 A1, for example, discloses the practice of progressively flattening the supporting flanks of the firtree root of a turbine rotor blade from a central region toward the end side of the blade root. However, this measure is only used to set the vibration properties of the blades. In the case of compressor blades and also fan blades, measures for manipulating the size of the contact surface of the interlocking blade root features are furthermore known: thus, US 2013/0224036 A1 discloses a recess above the supporting flank of the blade root, which recess extends from the downstream end of the blade root toward the center over an axial length of 30% of the blade root. An even longer recess for the purpose of stress reduction is disclosed by US 2008/0063529 A1. A relief groove radially below the leading edge of the airfoil is disclosed by DE 10 2009 025 814 A1. This relief groove is used to avoid the blade snapping off.

SUMMARY OF INVENTION

It is therefore the object of the invention to provide a turbine rotor blade, the use of which in a blade carrier extends the life of the turbine rotor blade carrier.

The object relating to the invention is achieved by a turbine rotor blade as claimed in the independent claim.

Advantageous embodiments are specified in the dependent claims, which can be combined in the manner indicated.

According to the invention, it is envisaged that a flute adjoining one of the two end sides is arranged in at least one concave rounded portion, the extension of which flute along the side surfaces is less than that of the supporting flank and which reduces the supporting area of the supporting flank in comparison with the relevant supporting flank without a flute adjoining it.

The invention is based on the insight that the centrifugal loading caused in the blade carrier by the turbine rotor blade varies in magnitude along the extent of the retention groove. It has been found that stress concentrations which affect the predeterminable life of the blade carrier occur in the end regions of the blade carrier which lie upstream and downstream in respect of a flow direction of the working medium of the turbine. For this reason, it is helpful to reduce the stresses occurring there in order to extend the life of the blade carrier, e.g. a rotor disk.

The reduction in the stresses occurring there is achieved by virtue of the fact that the turbine rotor blade root is designed to have a stiffness that varies along the extent of the supporting flank (from one of the two end surfaces of the blade root to the other of the two end surfaces). The different stiffness levels are achieved by virtue of the fact that a flute adjoining at least one of the two end sides is arranged in the region of the concave rounded portion. The arrangement of the flute in the region of the concave rounded portion reduces the supporting cross section of the blade root which is available at this location. Thus, the blade root becomes more flexible at this location in comparison with the stiffness of the blade root in the center between the two mutually opposite flat end surfaces. The increased elasticity in the region of the end surfaces of the blade root leads to the contact pressure of the turbine rotor blade on the supporting flanks of the blade carrier under centrifugal force being locally reduced there and thus to the possibility of reducing the stress concentration in the blade carrier which previously occurred there. Consequently, a mechanical loading in the blade carrier is made more uniform along the extent of the retention groove from the upstream side to the downstream side, improving the life of the blade carrier overall and especially if the blade carrier is designed as a rotor disk.

At the same time, the supporting area of the supporting flank of the blade root is reduced by the flute, with the result that the effective contact area between the supporting flank of the turbine rotor blade and the supporting flank of the retention groove is reduced locally there. This too leads to a lower stress concentration in the blade carrier and thus likewise achieves the advantages described above.

According to a first advantageous embodiment, the flute has an edge contour with a sharp tapering end, which end points toward the opposite side wall. Thus, the notch loading in the region of the flute can be kept low.

Particular advantage is given to the development in which each side surface of the blade root has at least two supporting flanks and the blade root thus provides a firtree end surface contour, wherein the flute is arranged above the supporting flank which will undergo the highest mechanical loading under the action of centrifugal force owing to the matching of the dimensions of the turbine rotor blade root and of the corresponding retention groove of the blade carrier. Since this is often the supporting flank arranged at the lowest level, the flute is expediently arranged above the supporting flank arranged at the lowest level.

Of course, it is possible for at least one flute to be arranged above each supporting flank.

However, there is a particular advantage for the turbine rotor blade in which the airfoil comprises a pressure side wall and a suction side wall, which extend from a leading edge to a trailing edge for a working medium, and in which at least two flutes are provided, of which one of the two recesses adjoins the end surface on the leading-edge side and is provided simultaneously on the blade root side surface on the pressure side, and the other of the two flutes is arranged at the end surface on the trailing-edge side and simultaneously on the blade root side surface on the suction side. In other words: the flutes are diagonally opposite one another.

This embodiment takes account of the fact that the airfoil is also acted upon by flow forces, which impart a torque to the turbine rotor blade, which torque must be absorbed and compensated by the material of the blade carrier surrounding the retention grooves.

Particular advantage is given to the embodiment in which the end sides lie opposite one another at a 100%-standardized distance, and the length of the extent of the recess is not more than 10%, advantageously not more than 5%, of said distance. It has namely been found that even a comparatively small recess can lead to a significantly greater uniformity in the loads in the material of the blade carrier.

As a further advantage, in the case of the presence of two diagonally opposite flutes, the flutes which is further downstream is made longer in an axial direction than the flute arranged further upstream since it has been found that the loads caused by the flow forces in the downstream side are greater than on the side further upstream.

Overall, the invention relates to a turbine rotor blade for a thermal continuous flow machine, in which a transition region, as well as an aerodynamically curved airfoil adjoining same, follows a blade root for securing the turbine rotor blade to a rotor of the turbine from bottom to top along a notional blade longitudinal axis of the turbine rotor blade—to be more precise from a blade end on the fastening side to the opposite blade end on the blade tip side—wherein the blade root has two mutually opposite flat end surfaces and two mutually opposite contoured side surfaces connecting the two end surfaces to one another, in each of which side surfaces at least one supporting flank and one free flank is formed, forming a dovetail or firtree end surface contour, and in which the supporting flanks merge into the transition region or become the free flanks via concave rounded portions. In order to provide a turbine rotor blade, the use of which in a blade carrier extends the life of the turbine rotor blade carrier, it is proposed that a flute adjoining one of the two end sides is arranged in at least one concave rounded portion, the extension of which flute along the side surface is less than that of the supporting flank.

BRIEF DESCRIPTION OF THE DRAWINGS

The invention is explained in greater detail in the following description of the figures by means of a number of illustrative embodiments, which do not restrict the invention further. Here, further features and further advantages are indicated. Of the figures.

DETAILED DESCRIPTION OF INVENTION

In all the figures, identical features are provided with the same reference signs.

Figure 1:
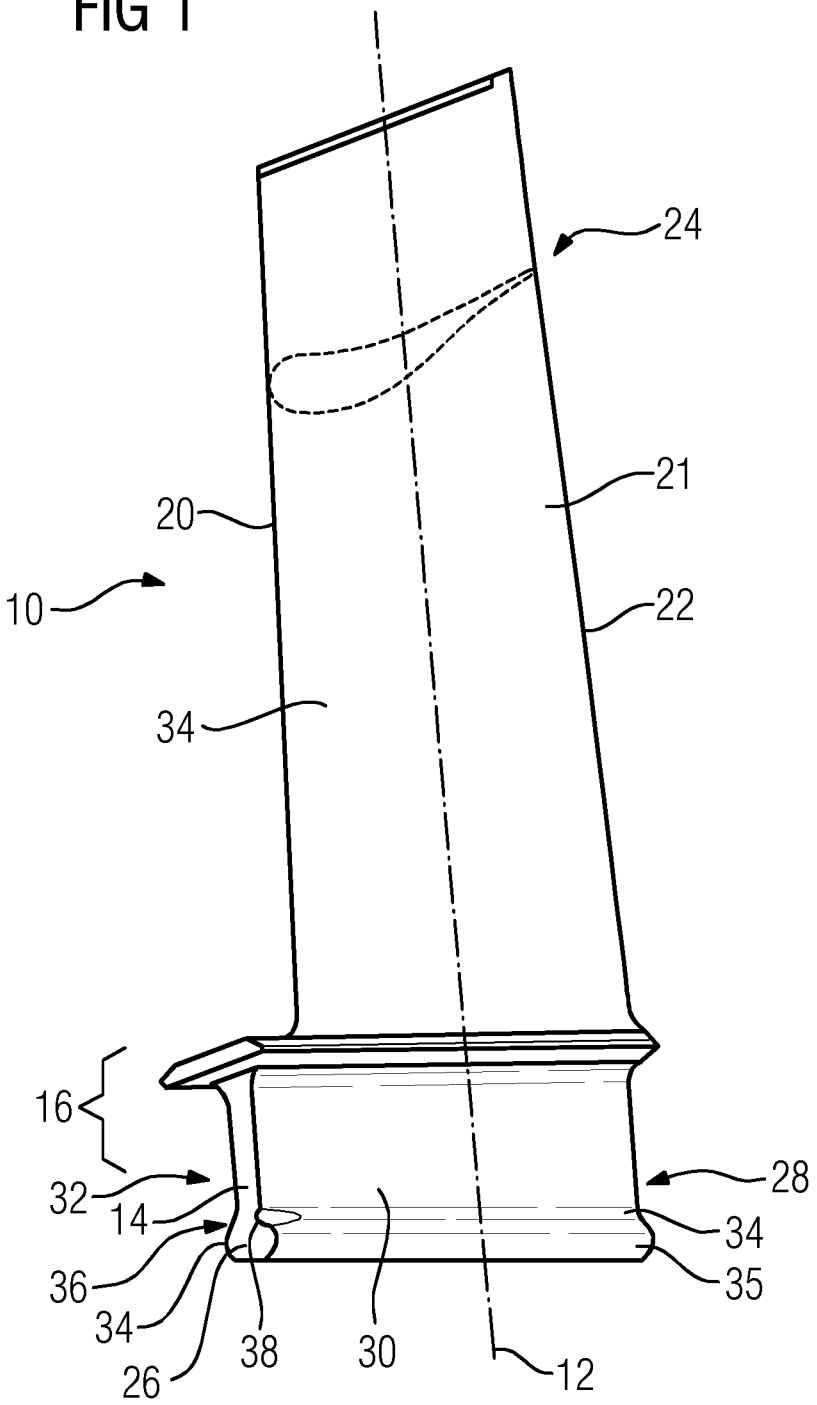
FIG. 1 shows a perspective illustration of a turbine rotor blade.

FIG. 1 shows a turbine rotor blade 10 in a perspective illustration. The turbine rotor blade 10 comprises, from bottom to top along a notional longitudinal axis 12, a blade root 14, adjoining which there is a transition region and, adjoining the latter, an aerodynamically curved airfoil 18. The airfoil 18 is aerodynamically curved in a known manner and comprises a leading edge 20 and a trailing edge 22, which are connected to one another by a pressure side wall 21 and a suction side wall 24.

In the illustrative embodiment shown, the blade root 14 is of dovetail design and thus comprises two flat end surfaces 26, 28, which lie opposite one another, of which one end surface 26 is arranged on the leading-edge side and the other end surface 28 is arranged on the trailing-edge side. The two end surfaces 26, 28 are connected to one another by means of two opposite side surfaces 30, 32, wherein, in each of said side surfaces 30, 32, a supporting flank 34 and a free flank 35 is formed, with the result that the contours of the end surfaces 26, 28 give a dovetail shape. The supporting flanks 34 merge via a concave rounded portion 36 into the transition region 16, which can comprise, on the one hand, a blade neck and, on the other hand, a platform, which can delimit the flow path of the thermal continuous flow machine on the rotor side.

The supporting flank 34 and the free flank 35 of the blade root 14, which are radially directly adjacent to one another, are connected to one another by a convex rounded portion and thus form a bead, which is arranged in the relevant side surface 30, 32 and which extends from the end surface 26 on the leading-edge side to the end surface 28 on the trailing-edge side.

Arranged in at least one concave rounded portion is a flute 38, which adjoins the end side 26 and the extent of which along the side surfaces 30 is less than that of the supporting flank 34 and which reduces the supporting area (see FIG. 2) of the supporting flank 34 (in comparison with the relevant supporting flank 34 without the flute adjoining it). By virtue of the flute 38, lower mechanical loads occur in a turbine rotor blade arrangement 40—comprising a turbine rotor blade carrier 42 which can be rotated during use as intended and on the outer circumference of which a multiplicity of retention grooves 48 are provided in a manner uniformly distributed along the circumference, and in which grooves the turbine rotor blade 10 is arranged, extending the life of the turbine rotor blade carrier 42.

Figure 2:
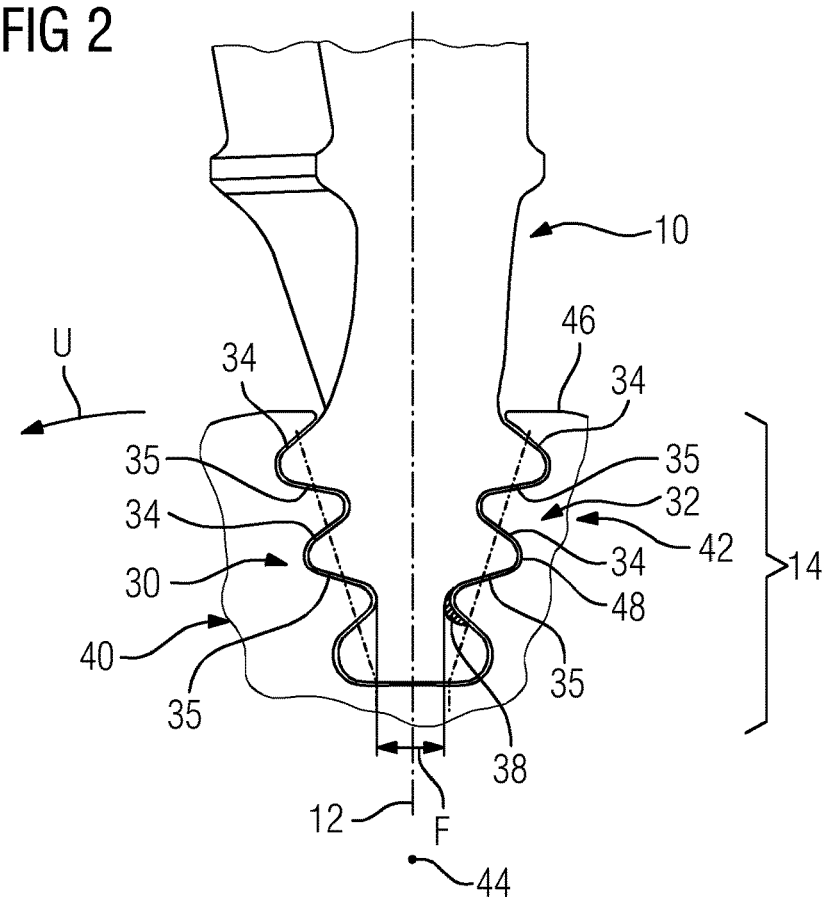
FIG. 2 shows the side view of the detail of a blade carrier having a retention groove and a turbine rotor blade seated therein.

FIG. 2 shows a detail of the turbine rotor blade arrangement 40, in which a turbine rotor blade carrier 42 is designed as a rotor disk, which can be rotated about a machine axis 44. Just one of the turbine rotor blade retention grooves 48 uniformly distributed along the circumference U, in which a turbine rotor blade 10 is inserted, is shown on the outer circumference 46 of the rotor disk 42. The supporting flanks 34 and free flanks 35 arranged in both side surfaces 30, 32 of the blade root 14 result in a contour in the form of a firtree for the end surface 26 of the blade root 14.

The supporting flanks 34 are configured symmetrically with respect to the notional longitudinal axis 12 of the turbine rotor blade 10. The flute 38 is arranged in such a way that the distance F between the opposite concave rounded portions 36 and the flute 38 is reduced in comparison with the distance without a flute. At the same time, the flute 38 is embodied in such a way that the contact area of the supporting flank 34 of the blade root 40 and of the supporting flank, opposite thereto, of the retention groove 48 is reduced in the region of the flute 38 in comparison with the contact region in which no flute is provided.

Figure 3:
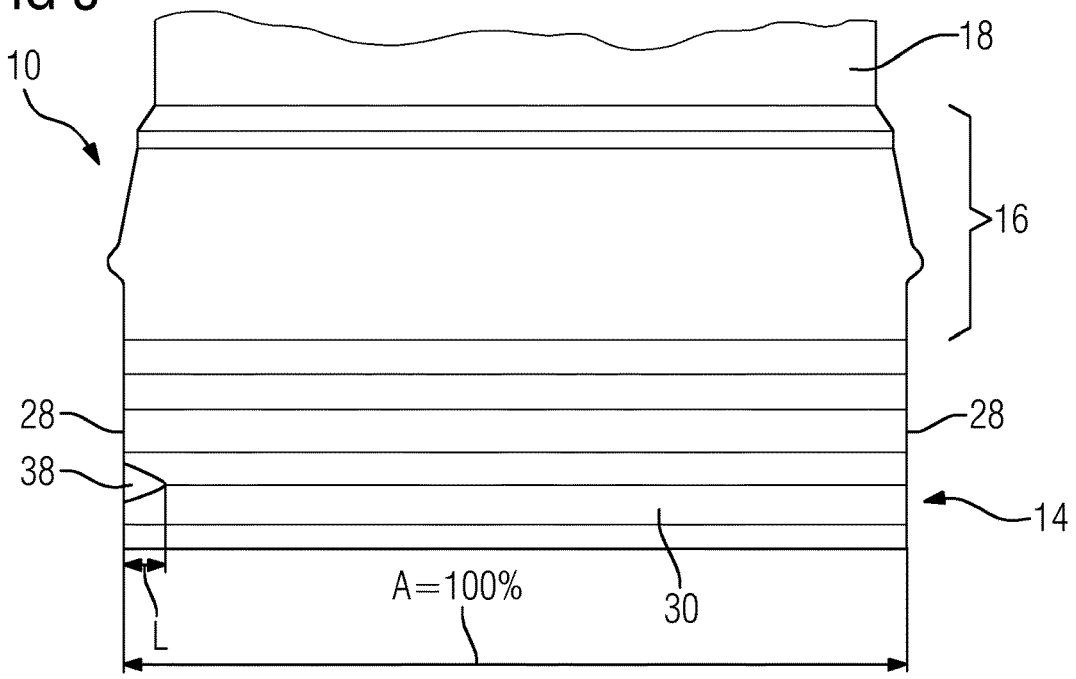
FIG. 3 shows the side view of the side surfaces of the blade root of the turbine rotor blade from FIG. 2.

FIG. 3 shows a plan view of the side surface 30 of the blade root 14 of the turbine rotor blade 10. The two flat end sides 26, 28 lie opposite one another at a 100%-standardized distance A, wherein the longitudinal extent of the flute 38 does not exceed a length L, measured from the end side 26 adjoined by the flute 38, amounting to 10%, advantageously not more than 5%, of the distance A. In this case, it amounts to 3%.

Figure 4:
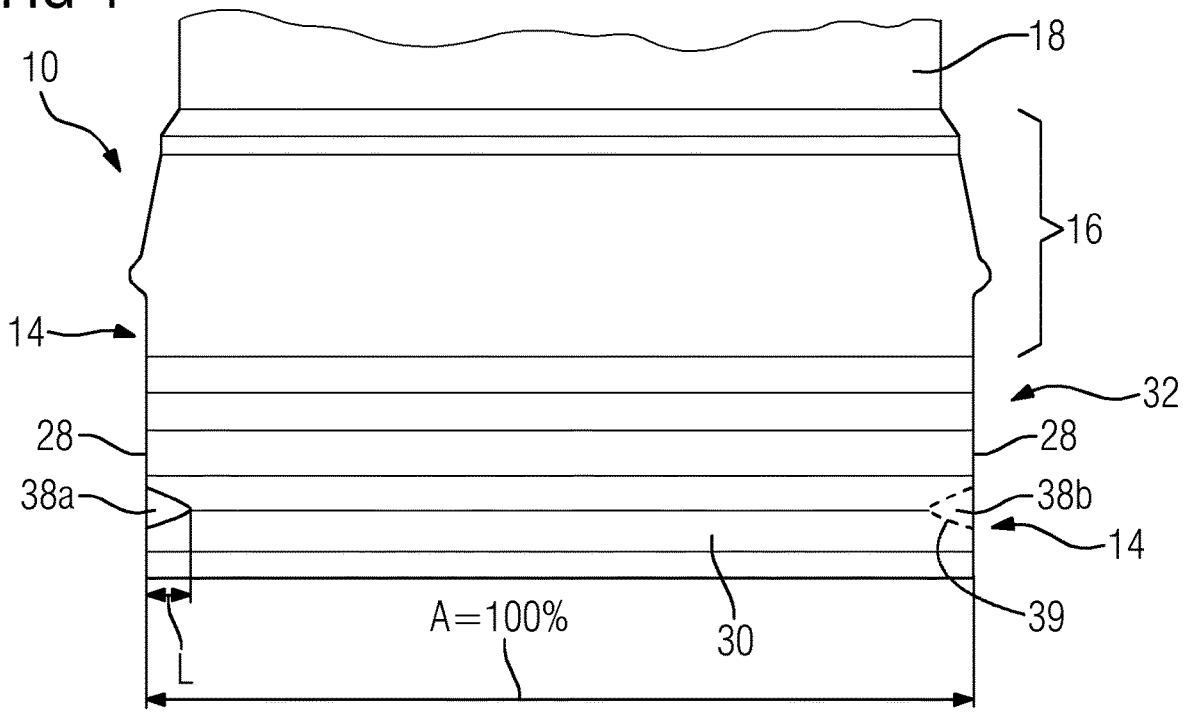
FIG. 4 shows the side view of the side surfaces of an alternate embodiment of the blade root of the turbine rotor blade.

FIG. 4 shows a plan view of the side surface 30 of the blade root 14 of an alternate embodiment of the turbine rotor blade 10. A first flute 38*a* adjoins the end surface 26 on the pressure side. A second flute 38*b* is arranged at the opposite end on the trailing edge side and on the side surface 32 on the suction side.

The invention claimed is:

1. A turbine rotor blade for a thermal continuous flow machine, comprising:

a transition region, as well as an aerodynamically curved airfoil adjoining same, which follows a blade root for securing the turbine rotor blade to a rotor of the thermal continuous flow machine from bottom to top along a notional blade longitudinal axis of the turbine rotor blade, wherein the blade root comprises two end surfaces that are mutually opposite and flat and two side surfaces that are mutually opposite and contoured and that the two end surfaces to one another, in each side surface of the two side surfaces at least one supporting flank is formed, and at least two flutes, each flute of the at least two flutes: recesses a contact surface of a respective flank of the at least one supporting flank; recesses a trough of a respective concave rounded portion of the blade root immediately adjacent the respective flank; adjoins a respective end surface of the two end surfaces; and extends along the contact surface for a distance that is less than a length of the contact surface, wherein a first flute of the at least two flutes adjoins a leading edge end surface of the two end surfaces and is disposed on a pressure side supporting flank that is disposed on a pressure side surface of the two side surfaces, and wherein a second flute of the at least two flutes adjoins a trailing edge end surface of the two end surfaces and is disposed on a suction side supporting flank that is disposed on a suction side surface of the two side surfaces.

2. The turbine rotor blade as claimed in claim 1, wherein each flute of the at least two flutes comprises an edge contour comprising a sharp tapering end that points toward an opposite end surface of the two end surfaces.

3. The turbine rotor blade as claimed in claim 1, wherein the at least one supporting flank comprises a lower supporting flank disposed below at least one upper supporting flank on the pressure side surface, and wherein the at least one supporting flank comprises a lower supporting flank disposed below at least one upper supporting flank on the suction side surface, wherein each flute of the at least two flutes is arranged above a respective lower supporting flank.

4. The turbine rotor blade as claimed in claim 1, wherein at least one flute of the at least two flutes is arranged above each supporting flank of the at least one supporting flank.

5. The turbine rotor blade as claimed in claim 1, wherein the two end surfaces lie opposite one another at a 100%-standardized distance, and an axial length of an extent of each flute of the at least two flutes is not more than 10%, of said distance.

6. The turbine rotor blade as claimed in claim 1, wherein the pressure side supporting flank and the suction side supporting flank are disposed at a same level along the notional blade longitudinal axis, and wherein axial lengths of the first flute and the second flute are different.

7. A turbine rotor blade arrangement comprising:

a turbine rotor blade carrier, which is rotatable in use and on an outer circumference of which a multiplicity of retention grooves is distributed uniformly along the outer circumference, in which multiplicity of retention grooves turbine rotor blades as claimed in claim 1 are arranged.

8. The turbine rotor blade as claimed in 5, wherein the axial length of the extent of each flute of the at least two flutes is not more than 5% of the 100%-standardized distance.

9. A turbine rotor blade for a thermal continuous flow machine, comprising:

a transition region, as well as an aerodynamically curved airfoil adjoining same, which follows a blade root for securing the turbine rotor blade to a rotor of the turbine from bottom to top along a notional blade longitudinal axis of the turbine rotor blade, wherein the blade root comprises two mutually opposite flat end surfaces and two mutually opposite contoured side surfaces connecting the two end surfaces to one another, in each of which side surfaces at least one supporting flank is formed, and in which the supporting flanks merge into the transition region or become free flanks via concave rounded portions, a flute adjoining one of the two end sides arranged in at least one concave rounded portion, the extension of which flute along the side surface is less than that of the supporting flank, wherein the flute comprises an edge contour with a sharp tapering end, which end points toward the opposite side wall, wherein the two end sides lie opposite one another at a 100%-standardized distance, and the axial length of the extent of the flute is not more than 10%, of said distance, wherein the airfoil comprises a pressure side wall and a suction side wall, which extend from a leading edge to a trailing edge for a working medium, and in which at least two flutes are provided, of which one of the at least two flutes adjoins the end surface on the leading-edge side and is provided on the side surface on the pressure side, and the other of the at least two flutes is arranged at the end surface on the trailing-edge side and on the side surface on the suction side, and wherein axial lengths of each flute of the at least two flutes situated diagonally opposite one another are different.

10. The turbine rotor blade as claimed in claim 9, wherein the at least two flutes are disposed at a same level along the notional blade longitudinal axis.

11. A turbine rotor blade for a thermal continuous flow machine, comprising:

a transition region, as well as an aerodynamically curved airfoil adjoining same, which follows a blade root for securing the turbine rotor blade to a rotor of the thermal continuous flow machine from bottom to top along a notional blade longitudinal axis of the turbine rotor blade, wherein the blade root comprises two end surfaces that are mutually opposite flat and two side surfaces that are mutually opposite and contoured and that connect the two end surfaces to one another, in each side surface of the two side surfaces at least one supporting flank is formed, and a flute that recesses a contact surface of a supporting flank of the least one supporting flank, that adjoins one of the two end sides, and that recesses a trough of a concave rounded portion of the blade root immediately adjacent the supporting flank, wherein an extension of the flute along a respective side surface of the two side surfaces is less than an extension of the supporting flank.

* * * * *